US006722251B2

(12) United States Patent
Keeling et al.

(10) Patent No.: US 6,722,251 B2
(45) Date of Patent: Apr. 20, 2004

(54) METHOD FOR LOADING A CONTINUOUS EXPLOSIVE CHARGE ASSEMBLY IN AN ELONGATED CAVITY

(75) Inventors: Paul S. Keeling, Edmond, OK (US); Brian F. Loader, Salem, UT (US)

(73) Assignee: UTeC Corporation, L.L.C., Riverton, KS (US)

( * ) Notice: Subject to any disclaimer, the term of this patent is extended or adjusted under 35 U.S.C. 154(b) by 0 days.

(21) Appl. No.: 10/286,322

(22) Filed: Oct. 31, 2002

(65) Prior Publication Data

US 2003/0079601 A1 May 1, 2003

Related U.S. Application Data

(62) Division of application No. 09/638,131, filed on Aug. 11, 2000, now Pat. No. 6,564,686.
(60) Provisional application No. 60/192,771, filed on Mar. 28, 2000.

(51) Int. Cl.[7] ..... F42B 3/087
(52) U.S. Cl. ..... 86/20.15; 102/313; 102/319; 102/322; 166/63; 175/4.52
(58) Field of Search ..... 86/20.15, 21, 22; 102/312, 313, 317, 323, 324, 333; 175/4.52; 166/63

(56) References Cited

U.S. PATENT DOCUMENTS

| | | | | |
|---|---|---|---|---|
| 848,512 | A | 3/1907 | Torras | |
| 1,549,794 | A | 8/1925 | Palmer | |
| 1,683,775 | A | 9/1928 | Henderson | |
| 2,704,031 | A | 3/1955 | Taylor | |
| 2,787,933 | A | 4/1957 | Wester | |
| 3,040,615 | A | 6/1962 | Johansson et al. | |
| 3,599,567 | A | 8/1971 | Graham et al. | |
| 3,791,255 | A | 2/1974 | Fox et al. | |
| 3,962,001 | A | 6/1976 | Marhofer et al. | |
| 4,240,349 | A | 12/1980 | Lash | |
| 4,380,948 | A | 4/1983 | Loving, Jr. et al. | |
| 5,343,002 | A | 8/1994 | Gremillion | |
| 6,070,511 | A | 6/2000 | Palmer et al. | |
| 6,564,686 | B1 * | 5/2003 | Keeling et al. | 86/20.15 |

FOREIGN PATENT DOCUMENTS

| | | | | |
|---|---|---|---|---|
| CA | 1023980 | | 1/1978 | |
| DE | 2257641 | * | 5/1974 | 86/20.15 |
| GB | 3 671148 | | 4/1952 | |
| NO | 119515 | | 5/1970 | |

* cited by examiner

*Primary Examiner*—Harold J. Tudor
(74) *Attorney, Agent, or Firm*—Mary M. Lee

(57) ABSTRACT

A method and apparatus for placement of continuous pre-split, gel explosive in an elongated borehole or cavity. An anchor is attached to one end of a selected length of continuous gel explosive. A suitable anchor is a flexible, plastic "pilgrim's hat" with a hole in the narrow, closed end. The size of the anchor depends on the width of the borehole; the flared skirt should be narrow enough to permit insertion of the anchor into the hole but wide enough to resist removal. One end of the explosive charge is pressed through the hole in the anchor. The remainder of the length of explosive is placed inside a tubular member, such as PVC pipe. The loaded pipe then is inserted into the borehole or cavity with the anchor leading. The pipe is used to push the anchor back into the hole to the desired depth. Then, the pipe is withdrawn. The flexible skirt on the anchor engages the sidewall of the borehole and thus resists removal with the pipe. As the pipe is pulled out of the borehole, the explosive charge is left behind in a substantially linear arrangement. The explosive is detonated in a conventional manner.

3 Claims, 2 Drawing Sheets

METHOD FOR LOADING A CONTINUOUS EXPLOSIVE CHARGE ASSEMBLY IN AN ELONGATED CAVITY

RELATED APPLICATIONS

This application is a divisional of application No. 09/638,131 filed Aug. 11, 2000, now U.S. Pat. No. 6,564,686 issued on May 20, 2003 and entitled CONTINUOUS EXPLOSIVE CHARGE ASSEMBLY AND METHOD FOR LOADING SAME IN AN ELONGATED CAVITY, which claims the benefit of the filing date of provisional application serial No. 60/192,771, filed Mar. 28, 2000, for CONTINUOUS EXPLOSIVE CHARGE ASSEMBLY AND METHOD FOR LOADING SAME IN AN ELONGATED CAVITY, the content of which is incorporated herein by reference.

FIELD OF THE INVENTION

The present invention relates generally to explosives and more specifically to continuous explosives and to methods for loading such explosives in elongated cavities.

SUMMARY OF THE INVENTION

The present invention is directed to an explosive assembly for installation in an elongate cavity. The assembly comprises a length of continuous elongated explosive charge having a first end and a second end. An anchor is provided on or near the first end of the explosive. The anchor is adapted to be insertable into the cavity without substantial resistance and to resist removal from the cavity. The assembly further includes a tube sized to receive and support the explosive charge. The tube is about the same length as the explosive charge and is adapted to support the charge in a non-folded condition while the explosive charge-filled tube is inserted into the cavity. The anchor can be pushed into cavity with the tube and the tube can be withdrawn from the cavity without withdrawing the anchor or the explosive charge. Thus, the length of explosive charge is positionable along the length of the cavity.

In another aspect, the invention is directed to method for installing a continuous explosive charge along the length of an elongated cavity. The method comprises the steps of first supporting a selected length of explosive charge in a generally linearly arrangement, and then inserting the linearly-supported explosive charge a distance into the elongated cavity.

Still further, the present invention comprises an assembly for installation of a length of continuous explosive in an elongate cavity, wherein the length of explosive has a first end and a second end. The assembly comprises an anchor connectable to or near the first end of the explosive. The anchor is adapted to be insertable into the cavity without substantial resistance and to resist removal from the cavity. The assembly further comprises a tube sized to receive and support the explosive charge. The tube is about the same length as the explosive charge and is adapted to support the charge in a non-folded condition while the explosive charge-filled tube is inserted into the cavity. In this way, the anchor can be pushed into cavity with the tube, and the tube can be withdrawn from the cavity without withdrawing the anchor or the explosive charge. Thus, the length of explosive charge is positionable along the length of the cavity.

In another embodiment, the present invention is directed to an explosive assembly for installation in an elongate cavity. This assembly comprises a length of continuous elongated explosive charge having a first end and a second end. Also included is an anchor on or near the first end of the explosive. The anchor is adapted to be insertable into the cavity without substantial resistance and to resist removal from the cavity. The anchor can be pushed into cavity while pulling the explosive charge behind it but resists withdrawal from the cavity when tension is applied to the explosive charge. Thus, the length of explosive charge is positionable along the length of the cavity.

DETAILED DESCRIPTION OF THE PREFERRED EMBODIMENT

In underground mining operations and in many other excavating and construction applications there is a need to set off a continuous charge along the length of a borehole or other elongated cavity, vertical and horizontal. For example, such elongated explosive applications are used to trim, cut, outline and/or pre-shear or pre-split underground tunnels, drifts, portals, benches, rooms and pillars, and upholes. Heretofore, placement of explosives in such cavities has been problematic and time consuming.

The present invention provides an explosive assembly for use in such applications and a method for placing such explosive assemblies. The assembly of this invention is inexpensive to manufacture, and the method is simple and more efficient than conventional methods.

Figure 1:
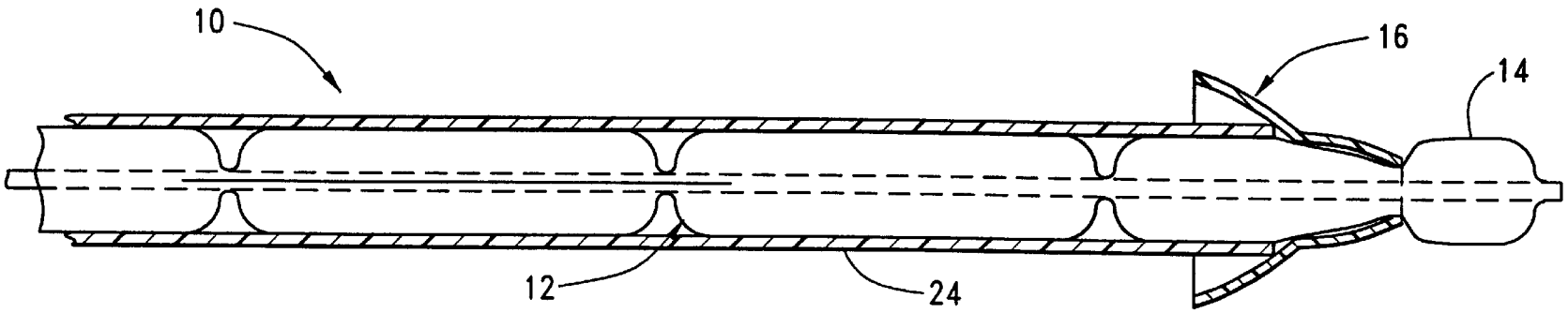
FIG. 1 is a partially sectional, side elevational view of a string of continuous extruded explosive inserted in a length of PVC pipe with an anchor near one end of the string in accordance with the apparatus and method of the present invention.

With reference now to the drawings in general and to FIG. 1 in particular, there is shown therein an explosive assembly made in accordance with the present invention and designated generally by the reference numeral 10. The explosive assembly 10 comprises an elongate or continuous explosive charge 12 having a first end 14 and a second end (not shown).

As used herein, "continuous charge" or "continuous explosive" refers to an explosive charge that is elongated and can be made in varying lengths. More preferably, the explosive comprises a continuous extrusion of gel explosive. More preferably, the explosive comprises a continuous extrusion of detonator-sensitive watergel explosive, such as aluminized hexamine nitrate slurry, having a continuous length of detonator cord extending therethrough. Even more preferably, the explosive comprises a continuous extrusion of detonator sensitive watergel explosive having a continuous length of detonator cord extending therethrough, the extrusion being crimped at regular intervals for ease of packaging and handling.

Such products are commercially available. One preferred such product is sold under the trade name Detagel Continuous PreSplit by Slurry Explosive Corporation of Oklahoma City, Okla. These explosive products are available in different diameters and lengths.

In accordance with the present invention, the explosive charge 12 will be provided in a selection of pre-cut lengths, such as 6, 8, 10 and 12 feet. Similarly, these charges will be provided in a variety of widths, such as ⅞ inch to 3 inches in diameter.

Figure 3:
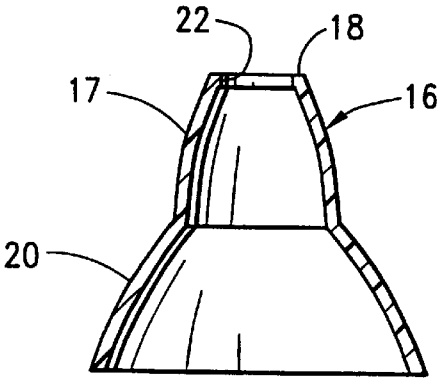
FIG. 3 is a side sectional view of the anchor of FIG. 2.
Figure 2:
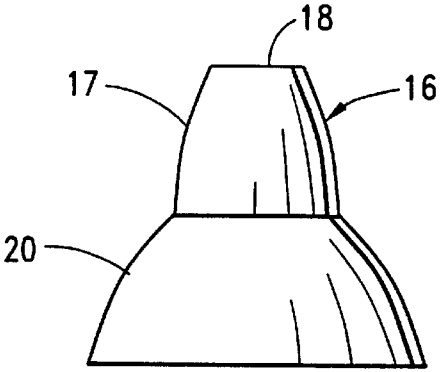
FIG. 2 is side elevational view of an anchor in accordance with the present invention.

The explosive assembly 10 further includes an anchor 16 for anchoring the end of the explosive charge 12 inside the borehole. While various devices may be employed, a preferred anchor is made from a conventional "pilgrim's hat" or "red hat" plug well known in the industry as a stemming device, one of which is illustrated in FIGS. 2 and 3.

The preferred anchor 16 is a hollow, conically shaped cup. A body portion 17 terminates in an end 18. A skirt or flange portion 20 flares out from the body 17. The anchor 16 preferably is made of flexible plastic and may be brightly colored. While the red hat type plug is preferred, it is to be understood that other devices may be employed as the anchor.

The size of the anchor 16 depends on the diameter of the explosive charge 12 and the internal diameter of the cavity in which it is to be used. For reasons that will become apparent, the resting diameter of the flange 20 should be slightly larger than the average internal diameter of the cavity.

In the preferred arrangement, the anchor 16 is attached near to or at the end of the explosive charge 12. For that purpose, a hole 22 may be provided in the end 18 of the anchor 16 for receiving the end portion of the explosive charge 12. As indicated previously, the preferred explosive is an extrudable watergel slurry, which is compressible. Thus, the hole 22 in the end 18 of the anchor 16 should be sized so that the end of the charge 12 can be squeezed through the hole to a desired distance.

This is but one means of attaching the anchor to the end of the explosive 12. Other ways to attach the anchor will be readily appreciated. For example, a length of detonator cord can be stripped beyond the last section of explosive. The bare cord can be threaded through the hole 22 in the end 18 of the anchor 16 and then knotted on itself or attached to some other stop device.

Still further the explosive assembly 10 of the present invention comprises a tube 24 for supporting the explosive charge 12 during insertion into the borehole or cavity in a manner yet to be described. The tube 24 can be PVC pipe or some other relatively rigid tubular material capable of supporting the explosive charge in a substantially linear arrangement, as illustrated in the FIG. 1.

The tube 24 should be sized to receive the explosive charge 12 in a manner that maintains the charge in an unfolded condition regardless of the position of the tube. In the preferred practice, the internal diameter of the tube 24 is only slightly larger than the diameter of the explosive 12.

The tube 24 may be rigid or flexible, so long as it is structurally capable of supporting the explosive 12 during insertion without kinking, folding or collapsing. The tube 24 preferably is about the same length as the explosive charge 12.

Figure 4:
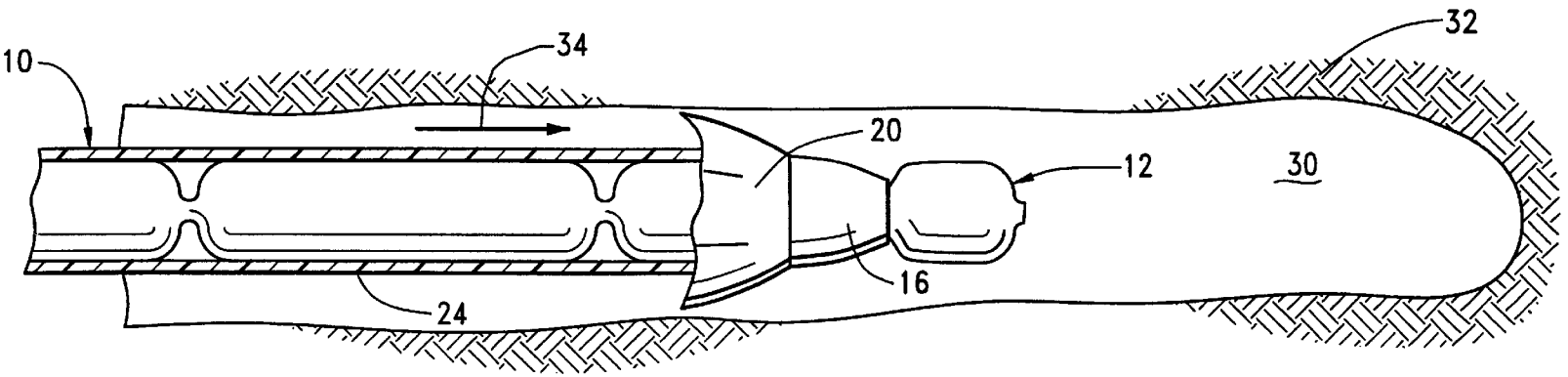
FIGS. 4 and 5 are side, partially sectional, partially cutaway views illustrating the use of the explosive assembly of FIG. 1 in accordance with the method of the present invention.
Figure 5:
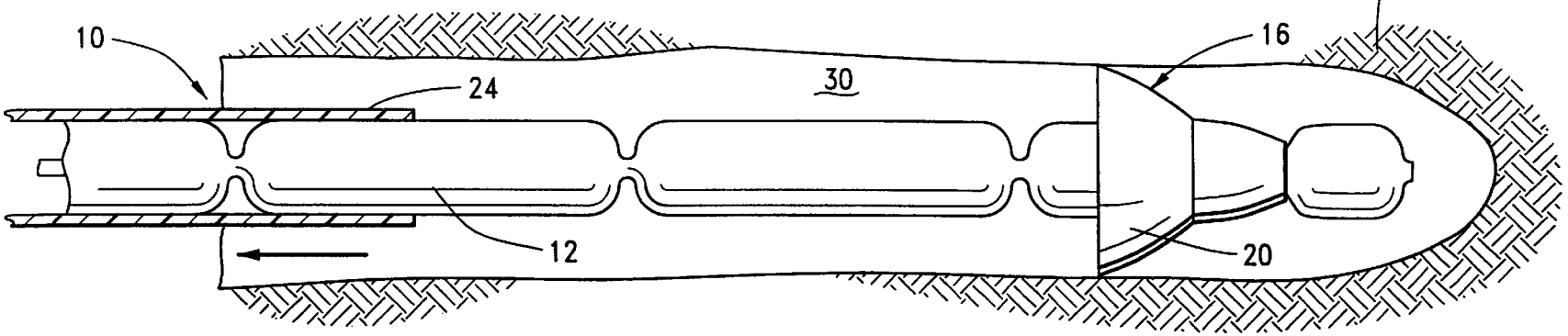

Turning now to FIGS. 4 and 5, the method of the present invention will be described. First the components of the assembly 10 are gathered. Next, the anchor 16 is attached to the end of a length of explosive charge 12 having a selected width and length. Then, the explosive charge 12 is threaded into the tube 24 beginning with the end opposite the anchor 16. It will be appreciated that the anchor 16 may be attached to the explosive 12 at the factory or at the site, whichever is preferred.

Having prepared the assembly 12, the assembly next is inserted in to the cavity 30 in surrounding rock or earth 32, as shown in FIG. 4, while supporting the charge in a generally linearly arrangement. As used herein, "linear" is not limited to straight, but may include a curve. It simply denotes supporting the charge in a substantially unfolded configuration. For example, when the elongated cavity is curved, a curved tube could be used to support the charge so that the assembly could be more easily inserted.

As illustrated, the end of the assembly 10 with the anchor 16 is inserted first and pushed into the cavity 30 using the tube 24. The flange 20 of the anchor, being flexible, may collapse slightly (See FIG. 4) to permit the assembly 12 to be forced into the cavity 30 to the desired depth in the direction of the arrow 34.

Once the assembly 12 has been inserted a distance into the cavity 30 to the desired depth, the tube 24 is withdrawn from the cavity. Any pulling action or tension applied to the explosive charge 12 by pulling out the tube 24 is resisted by the frictional engagement of the flange 20 of the anchor 16 as it expands and engages the sidewall of the cavity 30. Thus, placement of the explosive 12 is secured by the anchor 16, allowing quick removal of the tube 24. The explosive charge 12 then is detonated in the conventional manner.

Now it will be appreciated that the present invention provides a simple and inexpensive assembly and method for placement of a length of explosive charge in an elongate cavity. The anchor can be molded of plastic to provide an anchor which is inexpensive to manufacture and easy to attach to the end of the explosive. The tube is conveniently formed of plastic PVC (polyvinyl chloride) pipe, which is widely available in a range of lengths and widths. The method is simple and quick and can be practiced by any one at the site.

Changes can be made in the combination and arrangement of the various parts and steps described herein without departing from the spirit and scope of the invention. For example, the anchor may comprise an expansion device that is remotely operated from outside the cavity once placement of the assembly is completed. The anchor need only provide a device that can be pushed into the cavity without substantial resistance and yet serve to secure the explosive while the tube is withdrawn. Similarly, other types of tubes can be employed instead of the PVC pipe described above. For example, an ANFO hose and probe may be used as the tube.

What is claimed is:

1. A method for installing a length of foldable continuous explosive charge along the length of a preformed elongated cavity, the explosive charge having a forward end, the method comprising:

supporting a selected length of foldable continuous explosive charge in a generally linear arrangement, wherein the continuous explosive charge comprises a continuous extrusion of detonator-sensitive explosive having a continuous length of detonator cord extending therethrough; and inserting the linearly-supported, foldable continuous explosive charge a distance into the preformed elongated cavity so that the forward end of the explosive charge is exposed near the end of the preformed cavity.

2. The method of claim 1 wherein the supporting step is carried out by placing the length of explosive charge in a tube.

3. The method of claim 2 wherein the step of inserting the charge comprises:

anchoring the end of the explosive in the cavity; and removing the tube, leaving the explosive charge positioned lengthwise in the cavity.

* * * * *